US006174401B1

(12) United States Patent
Ogura

(10) Patent No.: US 6,174,401 B1
(45) Date of Patent: Jan. 16, 2001

(54) IMAGE RETRANSFER SHEET AND IMAGE RETRANSFER PROCESS MAKING USE OF THE SAME

(75) Inventor: Motohiro Ogura, Odawara (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/009,962

(22) Filed: Jan. 21, 1998

(30) Foreign Application Priority Data

Jan. 21, 1997 (JP) ..... 9-008911

(51) Int. Cl.[7] ..... B41M 5/26

(52) U.S. Cl. ..... 156/235; 428/331; 428/409; 428/423.1; 428/913; 428/914

(58) Field of Search ..... 428/195, 211, 428/423.1, 913, 914, 331, 409; 156/235; 503/227; 430/47, 97, 126

(56) References Cited

U.S. PATENT DOCUMENTS

| | | | | |
|---|---|---|---|---|
| 4,064,285 | | 12/1977 | Mammino | 427/24 |
| 5,530,532 | * | 6/1996 | Iino et al. | 355/256 |
| 5,745,830 | * | 4/1998 | Fujiwara et al. | 399/308 |

FOREIGN PATENT DOCUMENTS

| | | | |
|---|---|---|---|
| 52-82509 | 7/1977 | (JP) | 428/195 |

* cited by examiner

*Primary Examiner*—Bruce Hess
(74) *Attorney, Agent, or Firm*—Fitzpatrick, Cella, Harper & Scinto

(57) ABSTRACT

An image retransfer sheet is comprised of a base material having a surface with a high releasability and a cover layer containing a thermoplastic resin. The cover layer has a surface roughness Rz of from 3 to 10 μm. The image retransfer sheet enables easy and good retransfer to secondary transfer mediums and has a good paper transport performance in electrophotographic apparatus.

14 Claims, 4 Drawing Sheets

IMAGE RETRANSFER SHEET AND IMAGE RETRANSFER PROCESS MAKING USE OF THE SAME

BACKGROUND OF THE INVENTION

1. Field of the Invention

This invention relates to an image retransfer sheet through which an image once formed is retransferred to a secondary transfer medium by the action of heat and pressure, and more particularly to an image retransfer sheet through which a toner image formed using an electrophotographic apparatus, an electrostatic recording apparatus or the like is retransferred.

2. Related Background Art

Prior art relating to what is called decalcomania, a process by which images formed using an electrophotographic system are retransferred to a secondary transfer medium, is disclosed in, e.g., Japanese Patent Application Laid-open No. 52-82509. Image retransfer sheets used in this decalcomania are obtained by, e.g., forming on paper or plastic film on which a release layer comprised of a silicone resin or a fluororesine and having a high releasability has been formed an under coat layer comprised of a methyl methacrylate-n-butyl methacrylate copolymer, a polyvinyl acetate homogeneous polymer latex or a vinyl chloride-acrylate latex alone or in combination.

On the image retransfer sheet, toner images are formed using an electrophotographic apparatus or the like, and are fixed at least to such an extent that the toner images do not come off. After fixing, the image retransfer sheet is superposed on a secondary transfer medium (e.g., a cloth) face to face with the toner image side. In this state, they are heated under application of pressure to a temperature at which the toner and the under coat layer of the image retransfer sheet are softened, followed by cooling, and then the paper or the like having the release layer is peeled off in such a state that the toner images and the under coat layer are left on the secondary transfer medium side, thus the retransfer is completed.

The under coat layer used in this system is comprised of thermoplastic resin, where resins having a softening point equal or close to that of the toner resin are selected. Since the adhesion to the cloth or the like is attributable to the softening of this resin, practically the layer has a weak adhesive force and also a poor flexibility. In order to improve these points, the above Japanese Patent Application Laid-open No. 52-82509 discloses that a plasticizer is mixed in a thermoplastic resin to improve the flexibility of a resin film so that the re-fixing performance of toner resin on the cloth or the like may be ensured.

Mixing a plasticizer, however, tends to cause the toner resin to soften even after completion of retransfer, so that the images retransferred may adhere to any other article having come into touch with them, or retransfer-receiving surfaces may cling to each other if the secondary transfer medium is folded. In addition, in order to fully fix the toner images onto secondary transfer mediums such as cloth and wood, the former must be made to permeate into the latter under application of a considerably high pressure at the time of heating and pressing, and it is necessary to use a large-sized pressing machine for the exclusive use.

There is another method in which an aromatic hydrocarbon having a group containing a hydroxyl group is incorporated in the thermoplastic resin layer so that toner images may be retransferred to cloth or wood even under application of a low pressure. However, since the toner images may be transferred even when weakly heated and pressed, faulty paper transport may occur in electrophotographic apparatus.

SUMMARY OF THE INVENTION

The present invention was made to solve the above problems of prior art.

An object of the present invention is to provide an image retransfer sheet that enables easy and good retransfer to secondary transfer mediums and also has a good paper transport performance in electrophotographic apparatus.

Another object of the present invention is to provide an image retransfer process that enables good retransfer to secondary transfer mediums, using the image retransfer sheet having a good paper transport performance in electrophotographic apparatus.

The present invention is an image retransfer sheet comprising a base material having a surface with a high releasability and a cover layer formed thereon containing a thermoplastic resin, wherein;

The cover layer has a surface roughness Rz of from 3 to 10 $\mu$m. The Rz is 10-point average roughness as prescribed in JIS B0601.

The present invention is also an image retransfer process comprising the steps of;

forming a toner image by an electrophotographic system on an image retransfer sheet comprising a base material having a surface with a high releasability and a cover layer formed thereon containing a thermoplastic resin; said cover layer having a surface roughness Rz of from 3 to 10 $\mu$m;

bringing the image retransfer sheet into contact with a secondary transfer medium in such a way that the toner image comes into contact with the surface of the secondary transfer medium; and heating and pressing the image retransfer sheet to transfer the toner image to the secondary transfer medium together with the cover layer.

In the present invention, the surface roughness is defined so that the contact area of the image retransfer sheet may be made smaller when transported through the inside of a machine, inhibiting faulty transport, and in addition, since the properties of the thermoplastic resin are not deteriorated, a superior retransfer performance can be achieved. According to the present invention, the sheet is superior in paper transport performance in electrophotographic apparatus and the images may not be adversely affected and moreover can be readily retransferred to secondary transfer mediums such as cloth and wood under application of a relatively low pressure, e.g., using a household handy iron. Thus, the image retransfer sheet according to the invention is very useful especially in retransferring full-color images.

DESCRIPTION OF THE PREFERRED EMBODIMENTS

Embodiments of the present invention will be described below with reference to the accompanying drawings.

Figure 1:
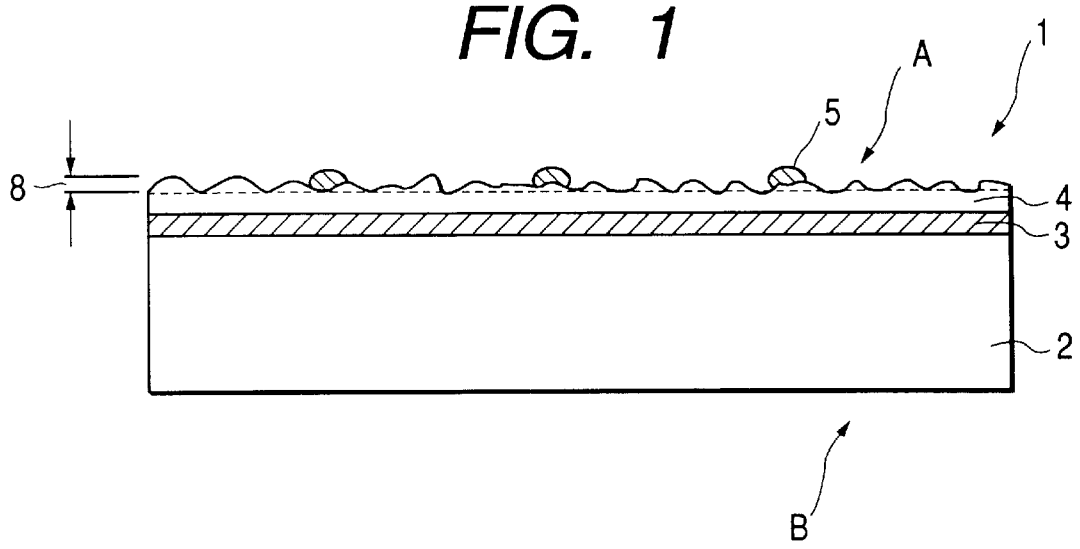
FIG. 1 is a diagrammatic cross section showing an example of the image retransfer sheet of the present invention.

FIG. 1 is a diagrammatic cross section showing an example of the image retransfer sheet (a toner image transfer material) of the present invention. This image retransfer sheet, denoted by reference numeral 1, comprises a base material 2, and a release layer 3 and a cover layer 4 superposed on the base material in this order.

The base material 2 is a heat-resistant base material made of paper, film material or the like. Specifically, paper such as general-use woodfree paper, mechanical paper or one-side coated paper may preferably be used. This base material 2 itself may preferably have a volume resistivity adjusted to about $10^8$ to $10^{11}$ Ω·cm which are within the range where it can be used in usual electrophotographic apparatus. Other than the paper, heat-resistant films such as polyethylene terephthalate film may also be used.

In order to prevent curling, a sealing layer may be provided on the back.

The release layer 3 formed on the base material 2 is a layer for providing a highly releasable surface that enables the cover layer to remain on the side of a secondary transfer medium 7 at the time of retransfer. More specifically, the highly releasable surface referred to in the present invention is meant to be a surface having an adhesion low enough to enable the cover layer to be transferred to the secondary transfer medium side in the step of retransfer described later. For example, silicone resin, fluororesin and other resins exhibiting a low surface energy may preferably be used. In the example shown in FIG. 1, the base material 2 and the release layer constitute the "base material having a highly releasable surface" referred to in the present invention and, specifically, commercially available silicone-coated paper may preferably be used. In the present invention, however, without limitation thereto, embodiments with various constitution may be used so long as they are so constituted as to function as described above.

The cover layer 4 formed on the release layer 3 contains a thermoplastic resin. This cover layer 4 will be detailed later.

The image retransfer sheet 1 shown in FIG. 1 is used to retransfer toner images 5 formed using an electrophotographic apparatus or the like, and has the shape of a sheet that can be fed through the electrophotographic apparatus. It will be described below as an example how to retransfer the toner images by the use of the image retransfer sheet of the present invention.

Figure 2:
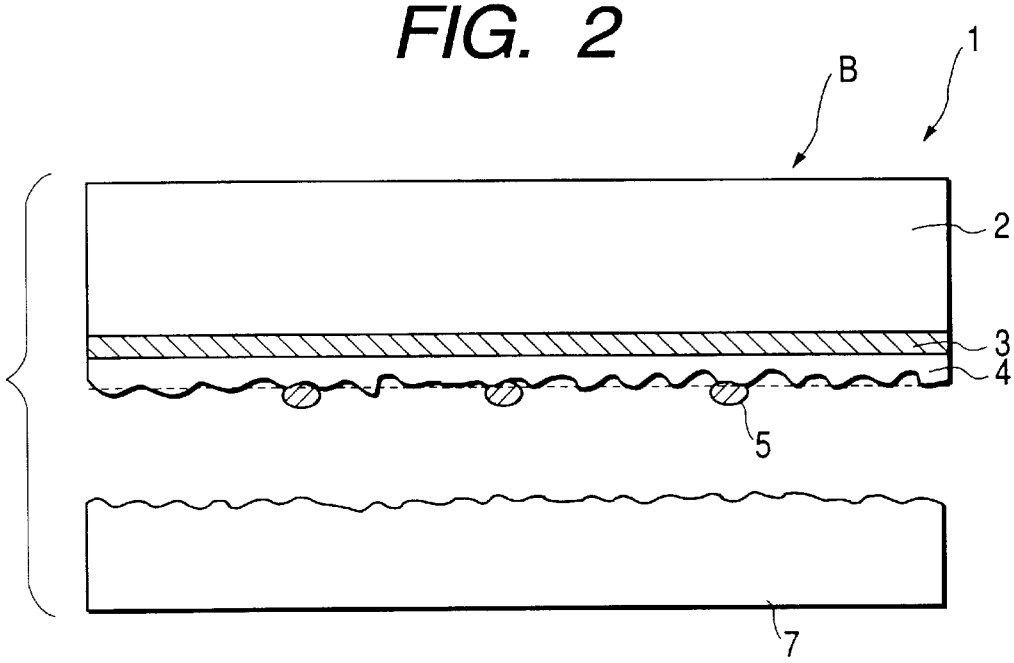
FIG. 2 is a diagrammatic cross section showing how toner images are retransferred using the image retransfer sheet of the present invention.
Figure 3:
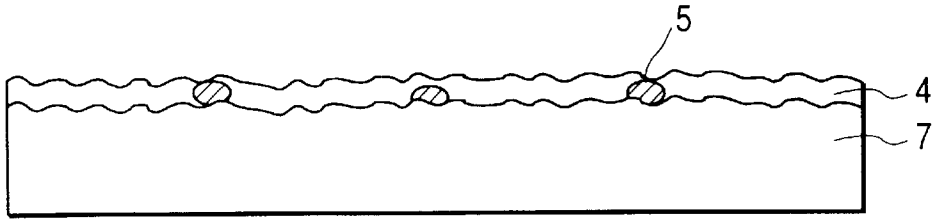
FIG. 3 is a diagrammatic cross section showing a secondary transfer medium to which images have been retransferred by means of the image retransfer sheet of the present invention.

First, as shown in FIG. 1, toner images 5 are formed on the cover layer 4 (A-side) by conventional electrophotography. Next, as shown in FIG. 2, the toner images 5 are brought into face-to-face contact with the secondary transfer medium (final transfer medium) 7. In the state of this contact, the image retransfer sheet is heated and pressed on the base material 2 side (B-side) by means of a household iron such as a handy iron, followed by cooling. Subsequently, the base material is peeled off. Thus, as shown in FIG. 3, the base material 2 having the release layer 3 can be removed with the toner images 5 and the cover layer 4 remaining on the secondary transfer medium 7 side. Thus, the toner images 5 are transferred and fixed to the secondary transfer medium 7.

The cover layer 4 will be detailed below. This cover layer 4 is, as mentioned above, a transfer layer that is transferred and moved to the secondary transfer medium 7 side together with the toner images 5 in the step of retransfer, and that maintains the fixing of the toner images 5 to the secondary transfer medium 7. Accordingly, as the thermoplastic resin incorporated in this cover layer 4, it is preferable to select a resin capable of being readily softened and also brought into a sufficiently fluid state by a relatively low-temperature heating unit such as an iron. For example, polyamides, polyurethanes, polyesters or the like may preferably be used. As a specific standard, it is preferable to use a resin having an apparent melt viscosity of $5\times10^5$ poises at a temperature ranging from 50 to 120° C. to which a transfer paper itself is heated with a usual household iron (set at, e.g., 180° C.), when measured using a high-load flow tester with a load of 10 kg/cm$^2$ and an orifice of 1 ml×1 mm diameter. It is more preferable to use a resin having a point at which the apparent melt viscosity in the region of from 50 to 100° C. comes to be the value of $5\times10^5$ poises. Isocyanate-modified polyurethane polyol polymers such as CRISBON 4407 and CRISBON AH-420 (trade name; available from Dainippon Ink and Chemicals, Incorporated) may preferably be used.

In the case when the secondary transfer medium is made of vegetable natural fibers such as cotton, the thermoplastic resin incorporated in the cover layer 4 may preferably be polyurethane, taking account of its texture and adhesion.

Resins having 600% or more elongation are more preferred.

In order to enable retransfer under application of a lower pressure, a resin whose viscosity decrease until the above molten state is very rapid is preferred. As a specific standard, a resin is preferred whose viscosity changes at a rate of $1\times10^5$ poises/5° C. or above around the temperature showing the viscosity of $5\times10^5$ poises.

The cover layer 4 may preferably have a thickness of at least 0.5 μm, and more preferably at least 1 μm from the viewpoint of ensuring the adhesion to cloth or the like. Considering that the image retransfer sheet is inhibited from having a low flexibility or causing cracks because of an increase in the thickness of the resin layer while retaining the feeling of its original material such as cloth or textile, it may preferably have a thickness not larger than 10 μm. Its optimum thickness ranges from 1 to 7 μm.

Figure 6:
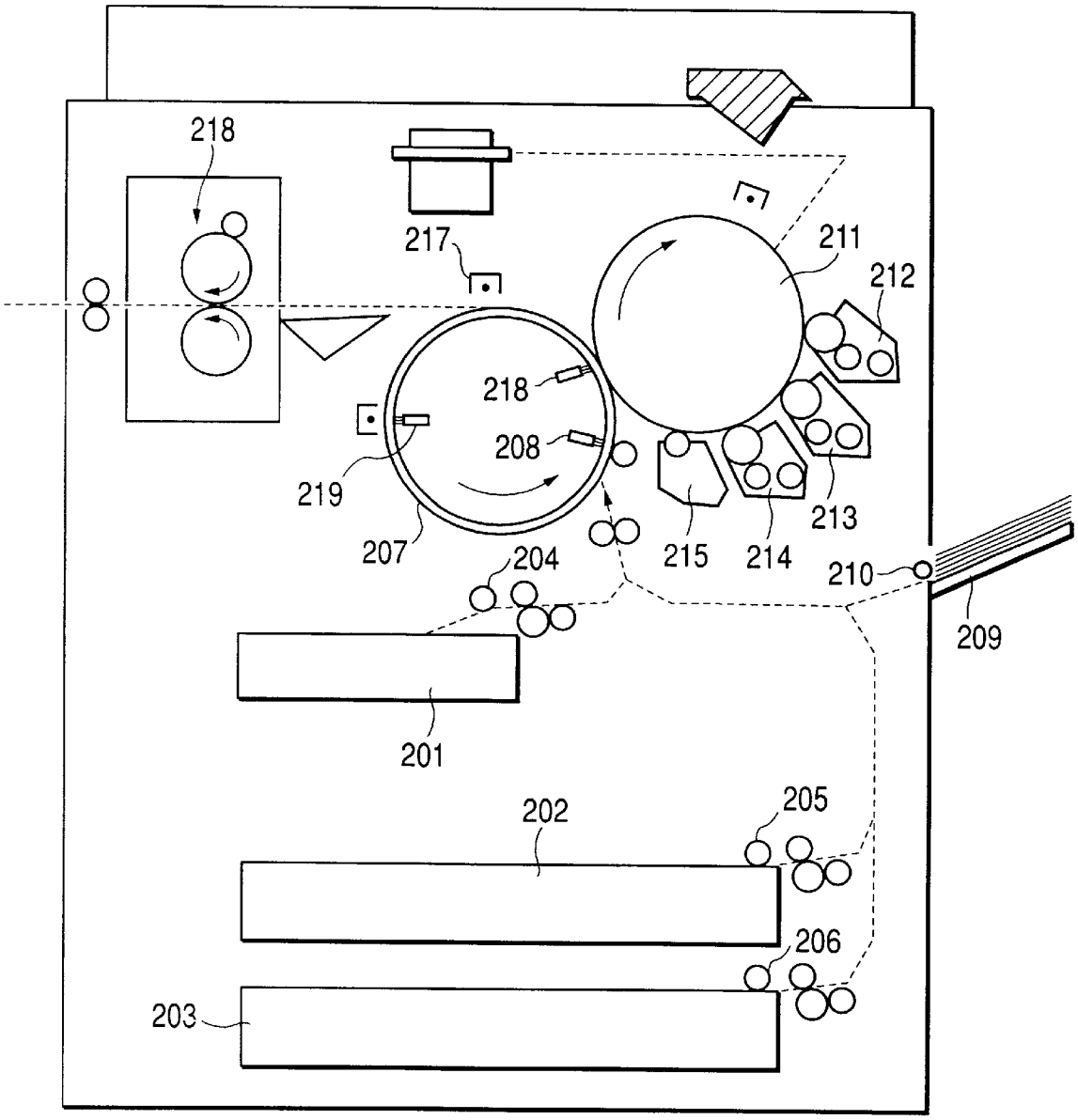
FIG. 6 is a side view showing the inner constitution of an electrophotographic apparatus used in the present invention.

FIG. 6 is a side view showing the inner constitution of an electrophotographic apparatus used in the present invention. Transfer mediums sheet by sheet pulled out of paper feed trays 201, 202 and 203 by paper feed rollers 204, 205 and 206 respectively provided above the trays are transported in the direction of an arrow depicted with dotted lines. Subsequently, electric current is sent to an attraction brush 208, whereby each transfer medium is electrostatically attracted to a transfer drum 207. Similarly, a transfer medium transported through a paper feed roller 210 from a manual paper feed tray 209 is also electrostatically attracted to the transfer drum 207.

A photosensitive drum 211 is positioned as shown in the drawing, and a yellow developing assembly 212, a magenta developing assembly 213, a cyan developing assembly 214 and a black developing assembly 215 are provided by the side of it. The transfer medium electrostatically attracted as described above is rotated in the direction of an arrow until the images formed using the four color developing assemblies are transferred to the transfer medium 207 side by the aid of a transfer brush 216.

Once the four-color transfer is completed, the transfer medium on the transfer drum 207 is separated from the transfer drum 207 by the operation of a separation charging assembly 217, and is transported in the direction of a dotted line, where the transferred images are fixed by the action of heat an d pressure in a fixing assembly 218, thus the sequence of full-color printing is completed and the desired full-color print image is formed. A numerical symbol 219 denotes a decharging brush.

The aforementioned surface roughness Rz of the image retransfer sheet 1 will be described. The surface roughness of the cover layer of the image retransfer sheet 1 can be controlled by a method in which a surface-roughing material, such as silica, is incorporated in the cover layer or a method in which the surface of the cover layer is roughed in the course of a coating step, e.g., silk screen printing or bar coating. The coating step will be detailed later. Namely, good paper transport performance and retransfer performance can be achieved when the surface roughness Rz, denoted as 8 in FIG. 1, is from 3 to 10 $\mu$m. More specifically, if it is smaller than 3 $\mu$m, the surface is so smooth that the faulty transport may occur. When the surface is too smooth, the contact area gets too large, so that the transfer medium attracted to the transfer drum 207 inside the electrophotographic apparatus clings to the photosensitive drum 211 even if the transfer medium is brought into slight touch with the transfer drum.

On the other hand, if the surface roughness Rz is greater than 10 $\mu$m, a faulty transfer may occur when solid images are formed. In addition, at the time of retransfer, the cover layer 4 is too rough to evenly enter the transfer medium side.

The silica for controlling the surface roughness will be described. It may preferably have an average particle diameter of from 1 to 5 $\mu$m. More specifically, if particles with diameters of 1 $\mu$m or smaller are present in a large quantity, it becomes very difficult to control the surface roughness within the above range. If particles with diameters of 5 $\mu$m or larger are present in a large quantity, the surface is too rough to prevent faulty retransfer.

With regard to the quantity of the silica, its use in a too large quantity results in a too hard film, making it meaningless to use the thermoplastic resin. Its use in a too small quantity makes it difficult to control the surface roughness within the above range. Accordingly, the silica may preferably be used in an amount of from 2 to 5 parts by weight, and more preferably from 3 to 4 parts by weight, based on 100 parts by weight of the thermoplastic resin.

The silk screen printing will be described below.

Figure 4:
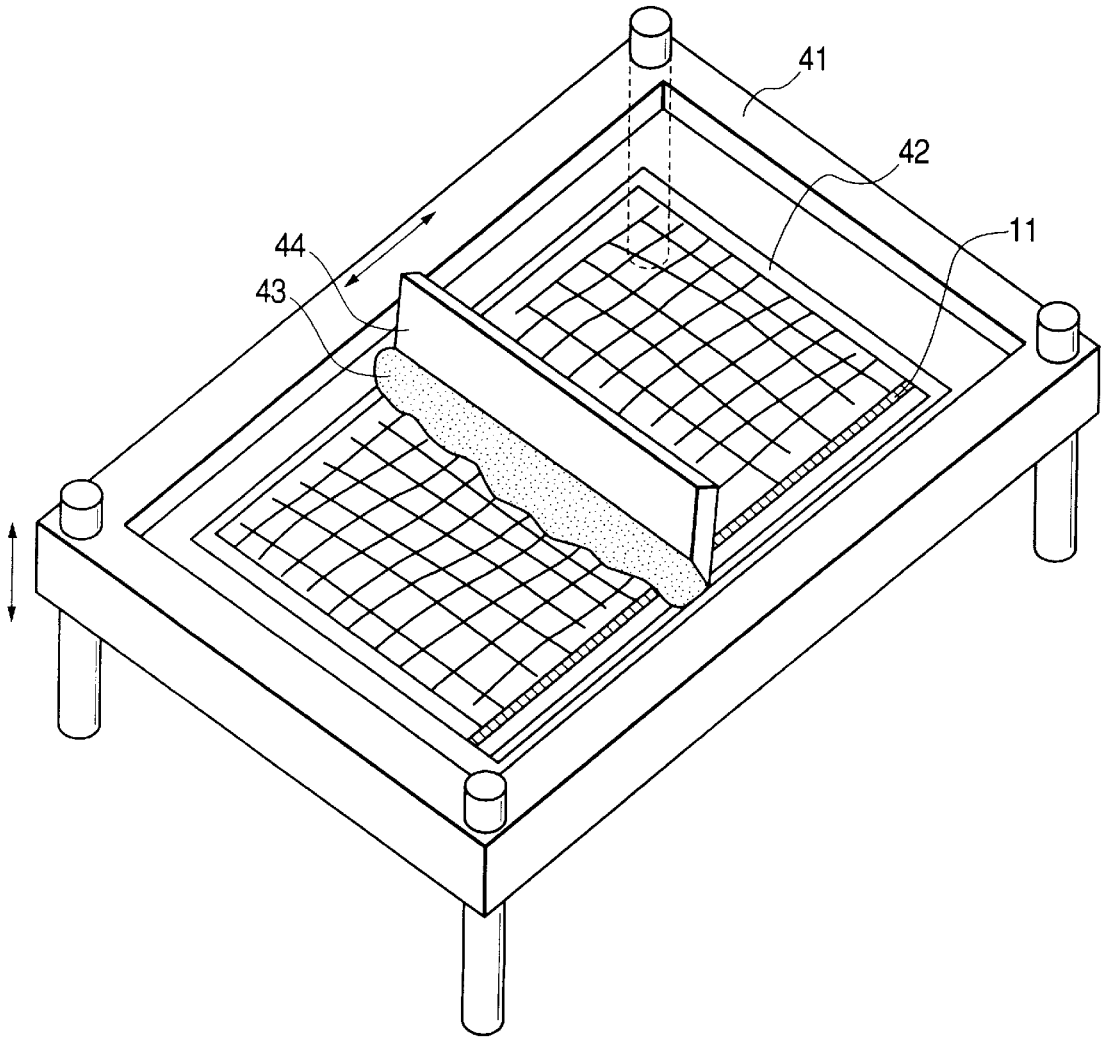
FIG. 4 is a schematic perspective view of a screen printer.

FIG. 4 is a schematic perspective view of a screen printer. FIGS. 5A to 5D are cross sections showing a process of screen printing. To carry out the screen printing, the four sides of a screen 42 (a meshy fabric made chiefly of nylon, Tetoron or stainless steel) is tensely fastened to a plate frame 41, and a plate film is made up thereon by a manual means or optical means. A screen printing ink 43 is put in the plate frame 41 having the form of a shallow ark, and the plate face is rubbed with a thick spatula-shaped rubber called a squeegee 44, under application of a pressure, so that the ink is passed through the screen 42 at the part of the plate film and pressed out on the surface of a print-receiving medium 11 placed beneath the plate face to make a print.

The screen printing has such features that the plate frame 41 can be changed for another to change the mesh of its screen 42, and the thickness and surface properties of coating films also can be controlled by the material of the screen 42, the hardness and angle of the squeegee 44 and the distance 52 between the plate frame 41 and the printing medium surface.

Figure 5A:
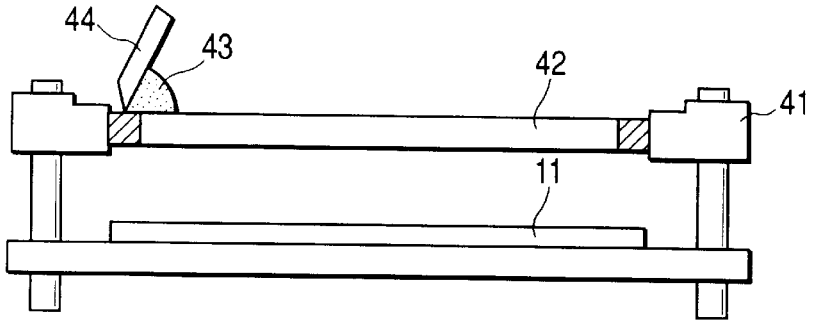
FIGS. 5A, 5B, 5C and 5D are cross sections showing a process of screen printing.
Figure 5B:
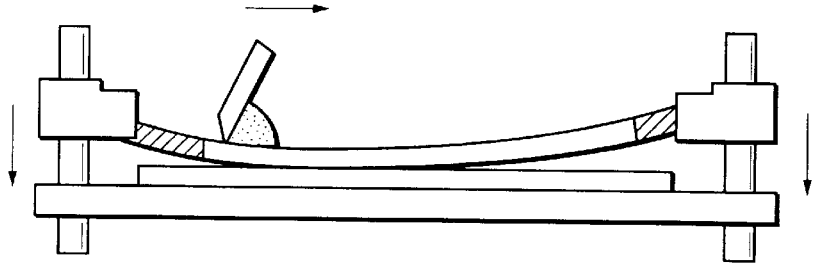
Figure 5C:
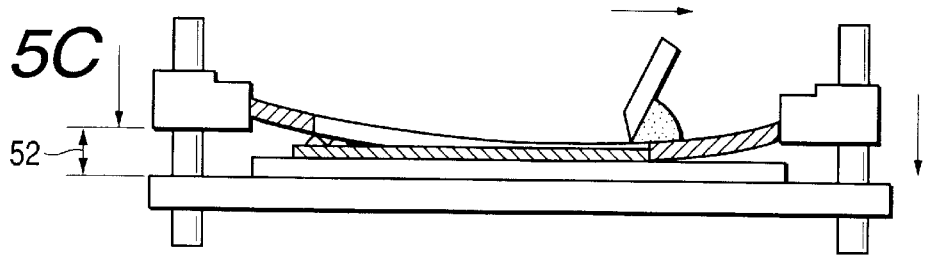
Figure 5D:
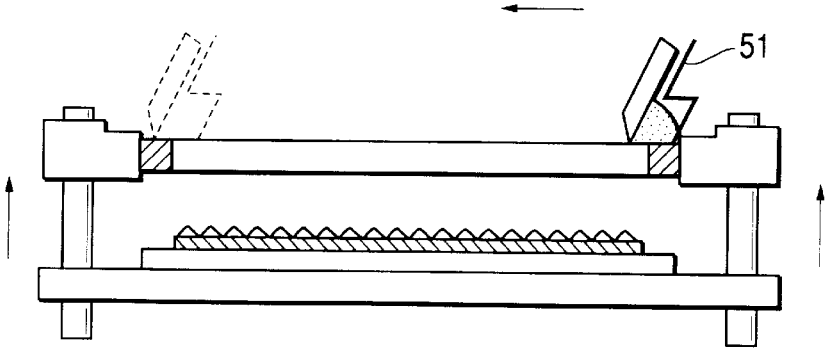

As shown in FIG. 5A, the ink 43 is put in the plate frame 41 and the hardness, angle and pressure of the squeegee 44 are adjusted. As shown FIG. 5B, the squeegee 44 moves as the plate frame 41 descends, and as shown in FIG. 5C, the ink 43 is applied on the print-receiving medium through the screen 42. In the step shown in FIG. 5D, the plate frame 41 ascends to complete the printing. The ink 43 remaining here is reserved in a portion called an ink scraper 51, and the same process is repeated in the next printing.

When coated in multi-layers, the printing by the same process may be carried out for each layer while repeating the same process after drying to carry out coating for the next layer.

In this way, the surface roughness 8 can be controlled within the range of the present invention.

As for the bar coating, the surface roughness can be controlled within the range of the present invention by adjusting the density of bar coating and the viscosity of coating solutions. Especially when the surface is roughed using a screen plate or a bar coater, it is preferred that the coating solution has lower leveling properties.

EXAMPLES

Example 1

A coating solution was prepared by mixing 100 parts by weight of an isocyanate-modified polyurethane polyol polymer (trade name; CRISBON 4407; available from Dainippon Ink and Chemicals, Incorporated), 30 parts by weight of benzyl alcohol and 3 parts by weight of silica [average particle diameter D95 (the 95th particle diameter from the smallest particle diameter in the particle size distribution): 9.5 $\mu$m; trade name: CS-7; available from Shionogi & Co., Ltd.].

This coating solution was applied by wet-coating on a commercially available silicone-coated paper (basis weight: 80 g/m$^2$) so as to be in a dried coating thickness of 5 $\mu$m by means of a bar coater making use of a wire of 50 $\mu$m diameter, followed by drying at 100° C. to remove the solvent.

On the surface of the coating film thus formed, a modified aromatic dimethylammonium sulfate (trade name: ELEGAN 264 WAX, available from Nippon Oil & Fats Co., Ltd.) as a cationic antistatic agent was applied so as to be $10^{10}$ ohms per square (23° C., 60% RH; measurement applied voltage: 100 V) in surface resistivity after drying, followed by re-drying to obtain an image retransfer sheet of the present invention.

The image retransfer sheet thus obtained had a surface roughness Rz of 3.5 $\mu$m.

On this image retransfer sheet, full-color toner images were formed using an electrophotographic apparatus (trade name: CLC700, manufactured by CANON INC.). The image retransfer sheet on which the toner images had been formed was brought into contact with a 100%-cotton cloth in such a manner as shown in FIG. 2, followed by heating using a household iron which was set at 180° C. After this heating was completed, the silicone coated paper was slowly peeled off the cloth, whereupon the toner images were transferred to the cloth together with the coating film to achieve 100% transfer.

When any lifting or uneven gloss was observed, if necessary, the above silicone-coated paper was further superposed on the cloth with toner images in the way that the silicone-coated surface was in agreement with the transferred toner images, followed by heating again at a temperature set to 180° C. In this instance too, after well cooled, the silicone-coated paper was peeled off to complete the retransfer of toner images.

The cloth to which the toner images had been retransferred was washed in a usual washing machine. As a result, the toner images did not come off, and a good adhesion was confirmed. In addition, the toner images did not adhere to other members inside the electrophotographic apparatus, and the paper transport performance was so good that there was no problem even when 200 sheets were successively fed.

Example 2

A coating solution was prepared by mixing 100 parts by weight of an isocyanate-modified polyurethane polyol polymer (trade name; TIFORCE 946HV; available from Dainippon Ink and Chemicals, Incorporated) and 30 parts by weight of benzyl alcohol together.

An image retransfer sheet was obtained in the same manner as in Example 1 except that this coating solution was applied by wet-coating on a commercially available silicone-coated paper (basis weight: 80 g/m$^2$) so as to be in a dried coating thickness of 5 $\mu$m by screen printing using a Tetoron screen of 180 meshes, followed by drying at 100° C. to remove the solvent.

The image retransfer sheet thus obtained had a surface roughness Rz of 4.0 $\mu$m.

On this image retransfer sheet, full-color toner images were formed using an electrophotographic apparatus (trade name: CLC700, manufactured by CANON INC.). The image retransfer sheet on which the toner images had been formed was brought into contact with a 100%-cotton cloth in such a manner as shown in FIG. 2, followed by heating using a household iron which was set at 180° C. After this heating was completed, the silicone coated paper was slowly peeled off the cloth, whereupon the toner images were transferred to the cloth together with the coating film to achieve 100% transfer.

When any lifting or uneven gloss was observed, if necessary, the above silicone-coated paper was further superposed on the cloth with toner images in the way that the silicone-coated surface was in agreement with the transferred toner images, followed by heating again at a temperature set to 180° C. In this instance too, after well cooled, the silicone-coated paper was peeled off to complete the retransfer of toner images.

The cloth to which the toner images had been retransferred was washed in a usual washing machine. As a result, the toner images did not come off, and a good adhesion was confirmed. In addition, the toner images did not adhere to other members inside the electrophotographic apparatus, and the paper transport performance was as good as that in Example 1.

Example 3

An image retransfer sheet was obtained in the same manner as in Example 1 except that the coating solution in Example 2 was applied by wet-coating on a commercially available silicone-coated paper (basis weight: 80 g/m$^2$) so as to be in a dried coating thickness of 6 $\mu$m by means of a bar coater making use of a wire of 100 $\mu$m diameter, about twice thicker than a usual wire of 50 $\mu$m diameter, followed by drying at 100° C. to remove the solvent.

The image retransfer sheet thus obtained had a surface roughness Rz of 5.3 $\mu$m.

On this image retransfer sheet, full-color toner images were formed using an electrophotographic apparatus (trade name: CLC700, manufactured by CANON INC.). The image retransfer sheet on which the toner images had been formed was brought into contact with a 100%-cotton cloth in such a manner as shown in FIG. 2, followed by heating using a household iron which was set at 180° C. After this heating was completed, the silicone coated paper was slowly peeled off the cloth, whereupon the toner images were transferred to the cloth together with the coating film to achieve 100% transfer.

When any lifting or uneven gloss was observed, if necessary, the above silicone-coated paper was further superposed on the cloth with toner images in the way that the silicone-coated surface was in agreement with the transferred toner images, followed by heating again at a temperature set to 180° C. In this instance too, after cooled well, the silicone-coated paper was peeled off to complete the retransfer of toner images.

The cloth to which the toner images had been retransferred was washed in a usual washing machine. As a result, the toner images did not come off, and a good adhesion was confirmed. In addition, the toner images did not adhere to other members inside the electrophotographic apparatus, and the paper transport performance was as good as that in Example 1.

Comparative Example 1

An image retransfer sheet was obtained in the same manner as in Example 1 except that the silica was not mixed. The image retransfer sheet thus obtained had a surface roughness Rz of 1.0 $\mu$m.

Such image retransfer sheets were successively passed through an electrophotographic apparatus (trade name: CLC700, manufactured by CANON INC.). As a result, the 50th image retransfer sheet clinged to the photosensitive drum.

Comparative Example 2

An image retransfer sheet was obtained in the same manner as in Example 1 except that the amount of the silica used therein was changed to 1 part by weight. The image retransfer sheet thus obtained had a surface roughness Rz of 2.3 $\mu$m.

Such image retransfer sheets were successively passed in through an electrophotographic apparatus (trade name: CLC700, manufactured by CANON INC.). As a result, the 95th image retransfer sheet clinged to the photosensitive drum.

Comparative Example 3

An image retransfer sheet was obtained in the same manner as in Example 1 except that the amount of the silica used therein was changed to 6 part by weight. The image retransfer sheet thus obtained had a surface roughness Rz of 15 $\mu$m because of occurrence of secondary agglomerates of silica.

Such image retransfer sheets were passed through an electrophotographic apparatus (trade name: CLC700, manufactured by CANON INC.). As a result, a good paper transport performance was attained.

However, when retransferred and tested in the same manner as in Example 1, the toner images came off upon washing.

Comparative Example 4

An image retransfer sheet was obtained in the same manner as in Example 2 except that the screen used therein was changed to a screen of 70 meshes. The image retransfer sheet thus obtained had a surface roughness Rz of 12 μm, and was not coated at some areas.

Such image retransfer sheets were passed through an electrophotographic apparatus (trade name: CLC700, manufactured by CANON INC.). As a result, a good paper transport performance was attained.

However, the image retransfer sheet had so poor a surface condition that neither image transfer performance nor retransfer performance were satisfactory.

Comparative Example 5

An image retransfer sheet was obtained in the same manner as in Example 3 except that the bar coating was carried out so as to provide a roughness about four times greater (using a wire of 200 μm diameter) than usual bar coating. The image retransfer sheet thus obtained had a surface roughness Rz of 11 μm.

Such image retransfer sheets were passed through an electrophotographic apparatus (trade name: CLC700, manufactured by CANON INC.). As a result, a good paper transport performance was attained.

However, the image retransfer sheet was so poor in its surface condition that the base paper was exposed at some areas and neither image transfer performance nor retransfer performance were satisfactory.

The results are summarized in Table 1.

TABLE 1

(pbw: parts by weight)

| | Example | | | Comparative Example | | | | |
|---|---|---|---|---|---|---|---|---|
| | 1 | 2 | 3 | 1 | 2 | 3 | 4 | 5 |
| Thermoplastic resin: (pbw) | CRISBON 100 | TIFORCE 100 | TIFORCE 100 | CRISBON 100 | CRISBON 100 | TIFORCE 100 | TIFORCE 100 | TIFORCE 100 |
| Benzyl alcohol: (pbw) | 30 | 30 | 30 | 30 | 30 | 30 | 30 | 30 |
| Silica: (pbw) | CS-7 3 | | | | CS-7 1 | CS-7 6 | | |
| Surface roughness Rz: (μm) | 3.5 | 4.0 | 5.3 | 1.0 | 2.3 | 15 | 12 | 11 |
| Solid image transfer performance: | A | A | A | A | A | B | C | C |
| Retransfer performance: | A | A | A | A | A | C | C | C |
| Paper transport performance: | A | A | A | CC | C | A | A | A |
| Coating conditions: | Bar coater roughness level 1 | Screen mesh 180 | Bar coater roughness level 2 | Bar coater roughness level 1 | Bar coater roughness level 1 | Bar coater roughness level 1 | Screen mesh 70 | Bar coater roughness level 1 |

A: good; B: slightly poor; C: poor; CC: very poor

What is claimed is:

1. An image retransfer sheet comprising a base material having a surface with a high releasability and a cover layer formed thereon containing a thermoplastic resin, wherein;

said cover layer has a surface roughness Rz of from 3 to 10 μm.

2. The image retransfer sheet according to claim 1, wherein said cover layer contains silica.

3. The image retransfer sheet according to claim 2, wherein said silica has an average particle diameter of from 1 μm to 5 μm.

4. The image retransfer sheet according to claim 2, wherein said silica is contained in an amount of from 2 parts by weight to 5 parts by weight based on 100 parts by weight of the thermoplastic resin.

5. The image retransfer sheet according to claim 1, wherein said surface roughness Rz is controlled by conditions of coating.

6. The image retransfer sheet according to claim 5, wherein said coating is carried out by silk screen printing.

7. The image retransfer sheet according to claim 5, wherein said coating is carried out by bar coating.

8. The image retransfer sheet according to claim 1, wherein said thermoplastic resin is a polyurethane resin.

9. The image retransfer sheet according to claim 1, wherein said thermoplastic resin has an elongation of 600% or more.

10. The image retransfer sheet according to claim 1, wherein said cover layer has a thickness of from 1 μm to 10 μm.

11. An image retransfer process comprising the steps of;

forming a toner image by an electrophotographic system on an image retransfer sheet comprising a base material having a surface with a high releasability and a cover layer formed thereon containing a thermoplastic resin; said cover layer having a surface roughness Rz of from 3 to 10 μm;

bringing the image retransfer sheet into contact with a secondary transfer medium in such a way that the toner image comes into contact with the surface of the secondary transfer medium; and heating and pressing the image retransfer sheet to transfer the toner image to the secondary transfer medium together with the cover layer.

12. The image retransfer process according to claim 11, wherein said toner image is a full-color toner image.

13. The image retransfer process according to claim 11, wherein said secondary transfer medium is a material containing fibers.

14. The image retransfer process according to claim 11, wherein said secondary transfer medium is a cloth.

* * * * *

UNITED STATES PATENT AND TRADEMARK OFFICE

CERTIFICATE OF CORRECTION

PATENT NO. : 6,174,401 B1
DATED : January 16, 2001
INVENTOR(S) : Motohiro Ogura

It is certified that error appears in the above-identified patent and that said Letters Patent is hereby corrected as shown below:

Column 1,
Line 23, "fluororesine" should read -- fluororesin --.

Column 3,
Line 45, "stitution" should read -- stitutions --.

Column 5,
Line 9, "an d" should read -- and --.
Line 56, "is" should read -- are --.

Column 8,
Line 53, "part" should read -- parts --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*